US006966474B2

(12) United States Patent
Berg et al.

(10) Patent No.: US 6,966,474 B2
(45) Date of Patent: Nov. 22, 2005

(54) WEB ACCUMULATOR HAVING LIMITED TORQUE DISTURBANCE

(75) Inventors: Eric Christopher Berg, Maineville, OH (US); Stephen Douglas Congleton, Loveland, OH (US); Myron Lee Stuebe, Cincinnati, OH (US); Todd Michael Yeagle, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 100 days.

(21) Appl. No.: 10/428,210

(22) Filed: May 2, 2003

(65) Prior Publication Data

US 2004/0217143 A1 Nov. 4, 2004

(51) Int. Cl.[7] ..... B65H 20/24

(52) U.S. Cl. ..... 226/111; 226/113; 226/118.2; 226/42

(58) Field of Search ..... 226/111, 113, 226/118.2, 170, 106, 44, 42

(56) References Cited

U.S. PATENT DOCUMENTS 3,643,844 A * 2/1972 Hunter ..... 226/111
4,009,814 A 3/1977 Singh
4,223,822 A * 9/1980 Clitheroe ..... 226/42
4,356,946 A * 11/1982 Gaskell ..... 226/117
5,344,089 A 9/1994 Crowley et al.
5,407,513 A 4/1995 Hayden et al.
5,651,511 A 7/1997 Crowley et al.
5,659,229 A 8/1997 Rajala
5,999,248 A 12/1999 Wary et al.
6,050,517 A 4/2000 Dobrescu et al.
6,425,547 B1 7/2002 Singh
6,473,669 B2 10/2002 Rajala et al.
2001/0013561 A1 * 8/2001 Wild et al. ..... 242/418.1

FOREIGN PATENT DOCUMENTS

EP 0 378 721 A1 7/1990

* cited by examiner

*Primary Examiner*—Kathy Matecki
*Assistant Examiner*—Evan Langdon
(74) *Attorney, Agent, or Firm*—Jack L. Oney, Jr.; Matthew P. Fitzpatrick; Ken K. Patel

(57) ABSTRACT

A control arrangement decoupled two driven inputs for driven belt web accumulators using gear trains, gear trains with torque feed-forward control or gear trains with toque feed-forward control and velocity feedback control.

12 Claims, 6 Drawing Sheets

WEB ACCUMULATOR HAVING LIMITED TORQUE DISTURBANCE

BACKGROUND OF THE INVENTION

The present invention relates in general to web accumulators for accumulating and discharging a reserve portion of a continuous web passing through the accumulator to enable continuous operation of processing stations on either or both sides of the accumulator when the speed of the web moving through the processing stations temporarily varies between the two stations. More particularly, the present invention relates to a control arrangement for belt-powered web accumulators that limits torque disturbances between the input and output rollers of such accumulators.

A typical web accumulator consists of sets of fixed and movable web rollers with the web path passing around these rollers so that the length of accumulated web increases when the moveable rollers move away from the fixed rollers and decreases when the moveable rollers move toward the fixed rollers. In order to accumulate web, the velocity of the web flowing into the accumulator must exceed the velocity of the web flowing out of the accumulator. Similarly, to discharge web, the velocity of the web flowing out of the accumulator must exceed the velocity of the web flowing into the accumulator. The input and output rollers of accumulators may be powered by servomotors or drive shafts, while the remaining rollers in the accumulator are idler-rollers that are rotated by the web moving over the rollers.

Since idler rollers have inertia and a coefficient of drag associated with their rotary motion, a force must be imparted by the web to accelerate, maintain radial velocity, and decelerate each idler roller. Therefore, each idler roller in the accumulator induces undesired tension variations in the web. Because web tension is proportional to web strain, any tension variation also creates a strain variation.

For processes that are to deliver fixed amounts of relaxed web per unit time wherein the web is elastic and exhibits elastic behavior at least for strain values, it is common to define and elastic modulus E that describes the relationship between strain, $\epsilon$, in the direction of web flow, and tension, T, per unit width of web. For a given width of web, a web modulus, $E_w$, is defined which describes the relationship between web tension, T, and web strain, $\epsilon$, in the direction of web-flow. This relationship is: $T=\epsilon E_w$. For many materials, $E_w$, and therefore T, vary even within a particular lot of material. Such variations are no problem provided strain remains within the elastic region of the web; and, therefore, the primary objective for processes that deliver fixed amounts of relaxed web per unit time is to maintain target strain, rather than target tension, within acceptable limits.

In processes where strain variations need to be kept to a minimum and for weak webs in general, the size of the accumulator is limited by the number of idler rollers that can be turned by the web without the web being over-strained. Singh, U.S. Pat. No. 4,009,814, which is incorporated herein by reference, solves the strain problem resulting from idler rollers by introducing a chain or belt that is wrapped around sprockets or pulleys associated with the rollers in the accumulator so that each roller in the accumulator is powered by the same power sources that drive input and output rollers, respectively. Further, the rate of web accumulation or discharge is controlled by the difference in velocity between the input roller and the output roller. Herein, the Singh type of driven accumulator will be referred to as a belt-powered accumulator.

It is known to use servo-drives to drive belt-powered accumulators. However, unless the load inertia reflected onto each servomotor is negligible compared to the motor inertia, a substantial torque coupling can exist between the input and output roller servo drives. This torque coupling induces undesired speed variations on the input roller and the output roller when the opposing torque between the input roller and the output roller changes.

There is thus a need to provide a control arrangement for driven belt accumulators that limits torque disturbances between the input and output rollers of the accumulators.

SUMMARY OF THE INVENTION

This need is met by the invention of the present application wherein a control arrangement decouples two driven inputs for driven belt web accumulators using gear trains, gear trains with torque feed-forward control or gear trains with torque feed-forward control and velocity feedback control.

In accordance with the invention, a web accumulator comprises first and second sets of rotatably mounted web rollers, each of the web rollers being partially wrapped by a web when looped alternately from a web roller of the first set to a web roller of the second set in consecutive order, the second set of web rollers being mounted for movement relative to the first set of web rollers. A flexible drive element separate from the web rotates each web roller at approximately the speed of a web portion in contact with it when discharging web from the accumulator and when accumulating web in the accumulator. A driving apparatus is provided for driving two of an input web roller, an output web roller and movement of the second set of web rollers relative to the first set of web rollers. A controller is provided for controlling the driving apparatus to decoupled the two elements driven by the driving apparatus.

Other features and advantages of the invention will be apparent from a review of the detailed description of the invention and the drawings that form a part of the specification of the present application.

DETAILED DESCRIPTION OF THE INVENTION

Figure 1:
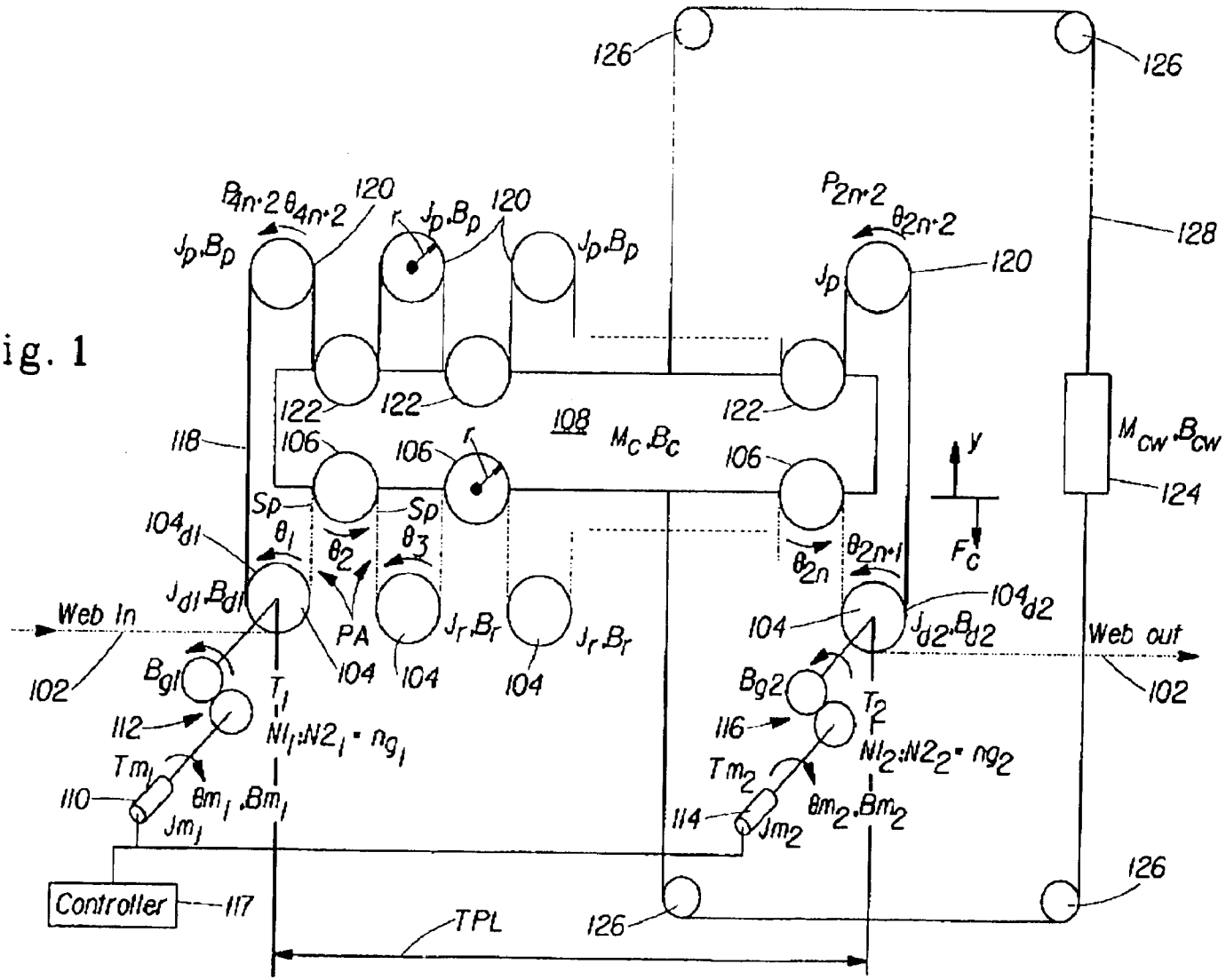
FIG. 1 is a diagrammatic view of a belt-powered accumulator operable in accordance with the present invention.

Reference will now be made to FIG. 1 that is a diagrammatic view of a belt-powered accumulator system 100 operable in accordance with the present invention. As shown in FIG. 1, a web 102 of material enters the accumulator 100 from the left and leaves the accumulator 100 to the right. In passing through the accumulator 100, the web 102 partially wraps around two sets of rotatably mounted web rollers 104, 106. The first or lower set of web rollers 104 are mounted to a bottom of a frame of the machine (not shown), while the second or upper set of web rollers 106 are mounted to a moveable carriage 108. In the illustrated embodiment, the accumulator 100 is controlled by driving a web input roller and a web output roller. In particular, the web input roller or first web roller $\mathbf{104}_{d1}$ is driven by a first servomotor 110 through a first gearbox 112 and the web output roller or last web roller $\mathbf{104}_{d2}$ is driven by a second servomotor 114 through a second gearbox 116. A controller 117 controls the first and second servomotors 110, 114 in accordance with aspects of the present invention as described below. Alternately, the carriage 108 can be driven by a linearly applied force, $F_c$, instead of either the web input roller or the web output roller, i.e., the accumulator 100 can be driven by driving any two of the input web roller $\mathbf{104}_{d1}$, the output web roller $\mathbf{104}_{d2}$ and the carriage 108.

A belt 118 follows the path of the web 102 through the accumulator 100 and is engaged with pulleys (P1 through P2n+1—not shown) aligned with and secured to the web rollers 104, 106. The belt 118 is in the same serpentine plane as the web 102. In addition, the belt 118 is engaged with two sets of pulleys 120, 122 (P2n+2 through P4n+2) mounted to the top of the frame of the machine (not shown) and the top of the moving carriage 108, respectively. The pulleys 120, 122 are arranged in a pattern that mirrors the web rollers 104, 106. One or more counterweights, represented by a counterweight 124 in FIG. 1, are attached to the moveable carriage 108 by a pulley arrangement including pulleys 126 and a belt 128 so that the carriage 108 is counterbalanced and does not move unless the sum of torque $T_1$ at the first servomotor 110 and torque $T_2$ at the second servomotor are non-zero, or a net force $F_c$ is applied directly to the carriage 108.

Numbering the pulleys associated with the rollers 104, 106 and the pulleys 120, 122 starting with the pulley for the first web roller $\mathbf{104}_{d1}$ on the lower left of the accumulator 100 and moving in the counter-clockwise direction as the pulleys are engaged by the belt 118 results in pulleys numbered from 1 through 4n+2, i.e., pulleys P1 through P4n+2. Designations for the angular positions of the pulleys P1 through P4n+2 are indicated in FIG. 1 as $\theta_1$ through $\theta_{4n+2}$.

A span Sp within the accumulator 100 is defined as the portion of web path from one of the fixed web rollers 104 mounted on the bottom of the frame, for example the first web roller $\mathbf{104}_{d1}$, to the corresponding web roller 106 (corresponding to pulley P2), see FIG. 1. A pass PA within the accumulator 100 is defined as two spans Sp, i.e., the web path from one of the fixed web rollers 104 mounted on the bottom of the frame, for example the first web roller $\mathbf{104}_{d1}$, around the corresponding web roller 106 (corresponding to pulley P2) on the moveable carriage 108 and back to the subsequent web roller 106 (corresponding to pulley P3) mounted on the bottom of the frame, and n indicates the number of passes of web in the accumulator 100. The total length of the web path through the accumulator 100 is defined as the total path length TPL and extends between the accumulator input roll, the first web roller $\mathbf{104}_{d1}$, and the accumulator output roll, the last web roller $\mathbf{104}_{d2}$.

Defining counter-clockwise rotation as positive, the radial velocity of any web roller/pulley is given by:

$$(-1)^{+1}\omega_1=((2n+1-i)/(2n))\omega_1+((i-1))/(2n))\omega_{2n+}1i=1,2,3\ldots,2n+1 \tag{1}$$

Where: $\omega_i=d\theta/dt$, and the velocity of the carriage 108 in the y direction in FIG. 1 is:

$$v=r(\omega_{1-}\omega_{2n+1})/(2n)=r(\omega m_1/ng_1-\omega n_2/ng_2)/(2n) \tag{2}$$

The dynamic equations of motion for the accumulator 100 are:

$$\left(n_{g1}^2 J_{m_1}+J_d+J_p\left(1+\frac{1}{4n^2}\sum_{i=2}^{2n}(2n+1-i)^2\right)+\frac{J}{4n^2}\sum_{i=2}^{2n}(2n+1-i)^2+\frac{Mr^2}{4n^2}\right)\frac{1}{n_{g1}^2}\alpha_{m_1}+\left(\frac{J_p}{4n^2}\sum_{i=2}^{2n}((2n+1-i)(i-1))+\frac{J}{4n^2}\sum_{i=2}^{2n}((2n+1-i)(i-1))-\frac{Mr^2}{4n^2}\right)\frac{1}{n_{g2}^2}\alpha_{m_2}+\left(n_{g1}^2 B_{m_1}+B_d+B_p\left(1+\frac{1}{4n^2}\sum_{i=2}^{2n}(2n+1-i)^2\right)+\frac{B_r}{4n^2}\sum_{i=2}^{2n}(2n+1-i)^2+\frac{B_y r^2}{4n^2}\right)\frac{1}{n_{g1}^2}\omega_{m_1}+\left(\frac{B_p}{4n^2}\sum_{i=2}^{2n}((2n+1-i)(i-1))+\frac{B_r}{4n^2}\sum_{i=2}^{2n}((2n+1-i)(i-1))-\frac{B_y r^2}{4n^2}\right)\frac{1}{n_{g2}^2}\omega_{m_2}=T_{m_1}-\frac{1}{n_{g1}}\frac{r}{2n}F_c \tag{3}$$

and $$\left(\frac{J_p}{4n^2}\sum_{i=2}^{2n}((2n+1-i)(i-1))+\frac{J}{4n^2}\sum_{i=2}^{2n}((2n+1-i)(i-1))-\frac{Mr^2}{4n^2}\right)\frac{1}{n_{g1}^2}\alpha_{m_1}+\left(n_{g2}^2 J_{m_2}+J_d+J_p\left(1+\frac{1}{4n^2}\sum_{i=2}^{2n}(2n+1-i)^2\right)+\frac{J}{4n^2}\sum_{i=2}^{2n}(2n+1-i)^2+\frac{Mr^2}{4n^2}\right)\frac{1}{n_{g2}^2}\alpha_{m_2}+\left(\frac{B_p}{4n^2}\sum_{i=2}^{2n}((2n+1-i)(i-1))+\frac{B_r}{4n^2}\sum_{i=2}^{2n}((2n+1-i)(i-1))-\frac{B_y r^2}{4n^2}\right)\frac{1}{n_{g1}^2}\omega_{m_1}+\left(n_{g2}^2 B_{m_2}+B_d+B_p\left(1+\frac{1}{4n^2}\sum_{i=2}^{2n}(2n+1-i)^2\right)+\frac{B_r}{4n^2}\sum_{i=2}^{2n}(2n+1-i)^2+\frac{B_y r^2}{4n^2}\right)\frac{1}{n_{g2}^2}\omega_{m_2}=Tm_2+\frac{1}{n_{g2}}\frac{r}{2n}F_c \tag{4}$$

Where: $n_{g1}$ is the gear ratio of the first gearbox 112 and $n_{g2}$ is the gear ratio of the second gearbox 116; $\omega m_1$ is the radial velocity of the first servomotor 110 and $\omega m_2$ is the radial velocity of the second servomotor 114; $\alpha m_1$ is the radial acceleration of the first servomotor 110 and $\alpha m_2$ is the radial acceleration of the second servomotor 114; $Tm_1$ is the torque generated by the first servomotor 110 and $Tm_2$ is the torque generated by the second servomotor 114; all web rollers 104, including associated pulleys, have inertia $J_r$, viscous friction $B_t$ and radius r; all pulleys P2n+1 through P4n+2 have inertia $J_p$, viscous friction $B_p$, and radius r; the driven rollers, first web roller 104$_{d1}$ and the last web roller 104$_{d2}$, including associated pulleys, shafts, and the inertia of the load end of their respective gearboxes, have inertia $J_d$, viscous friction $B_{d1}$ and radius r, where $B_d$ includes the viscous friction associated with the load end of the associated gearbox, 112, 116; the servomotors 110, 114 have inertia $J_{m1}$ and $J_{m2}$, including the inertia of the motor end of their respective gearboxes, and viscous frictions $B_{m1}$ and $B_{m2}$, respectively, with the viscous friction associated with the motor end of the gearboxes 112, 166 being included in $B_{m1}$ and $B_{m2}$, respectively; the carriage 108, including the rollers 106 and pulleys associated with the rollers 106 and the pulleys 122, has mass $M_c$ and viscous friction $B_c$ associated with translational motion in the y direction; the counterweight(s) 124, and associated pulley/belt system 126, 128, have an equivalent total mass $M_{cw}$ and viscous friction $B_{cw}$ associated with motion in the y direction of y; $M=M_c+M_{cw}$ is the equivalent total mass associated with translation motion of the counterweighted carriage in the y direction; and, $B_y=B_c+B_{cw}$ is the equivalent total viscous friction associated with translational motion of the counterweighted carriage in the y direction For given values of n and the other physical parameters of the accumulator system, equations (3) and (4) can be evaluated. Using linear algebra and equation (2) the accumulator system can be converted to state space form:

$$\begin{bmatrix} \alpha_{m_1} \\ \alpha_{m_2} \end{bmatrix} = A\begin{bmatrix} \omega_{m_1} \\ \omega_{m_2} \end{bmatrix} + B\begin{bmatrix} T_{m_1} \\ T_{m_2} \\ F_c \end{bmatrix} \tag{5}$$

$$\begin{bmatrix} \omega_{m_1} \\ \omega_{m_2} \\ v \end{bmatrix} = C\begin{bmatrix} \omega_{m_1} \\ \omega_{m_2} \end{bmatrix} + D\begin{bmatrix} T_{m_1} \\ T_{m_2} \\ F_c \end{bmatrix}$$

Where A is a 2×2 coefficient matrix and B is a 2×3 coefficient matrix, both of which are determined by algebraic manipulation of equations (1) through (4) into the "state space" form as is well known to those skilled in the art. C and D define the output equation as functions of the systems states and inputs:

$$C = \begin{bmatrix} 1 & 0 \\ 0 & 1 \\ 1/n_{g_1} & 1/n_{g_2} \end{bmatrix}, \text{ and } D = \begin{bmatrix} 0 & 0 & 0 \\ 0 & 0 & 0 \\ 0 & 0 & 0 \end{bmatrix}$$

The transfer function matrix, G is defined as:

$$G=C[sI-A]^{-1}B$$

And when evaluated and simplified, G becomes:

$$G = \begin{bmatrix} \frac{K1(s+c)}{(s+a)(s+b)} & \frac{-K2(s+d)}{(s+a)(s+b)} & \frac{K3}{(s+a)} \\ \frac{-K2(s+d)}{(s+a)(s+b)} & \frac{K1(s+c)}{(s+a)(s+b)} & \frac{-K3}{(s+a)} \\ \frac{-K4}{(s+a)} & \frac{K4}{(s+a)} & \frac{K5}{(s+a)} \end{bmatrix}$$

Where K1 through K5 are the gain coefficients associated with respective transfer functions. That is, the rows of G correspond to inputs and the columns of G correspond to outputs, so G(3,2) is the transfer function from input 3 to output 2. The transfer function matrix, G, is also displayed in block diagram form in FIG. 2.

Figure 2:
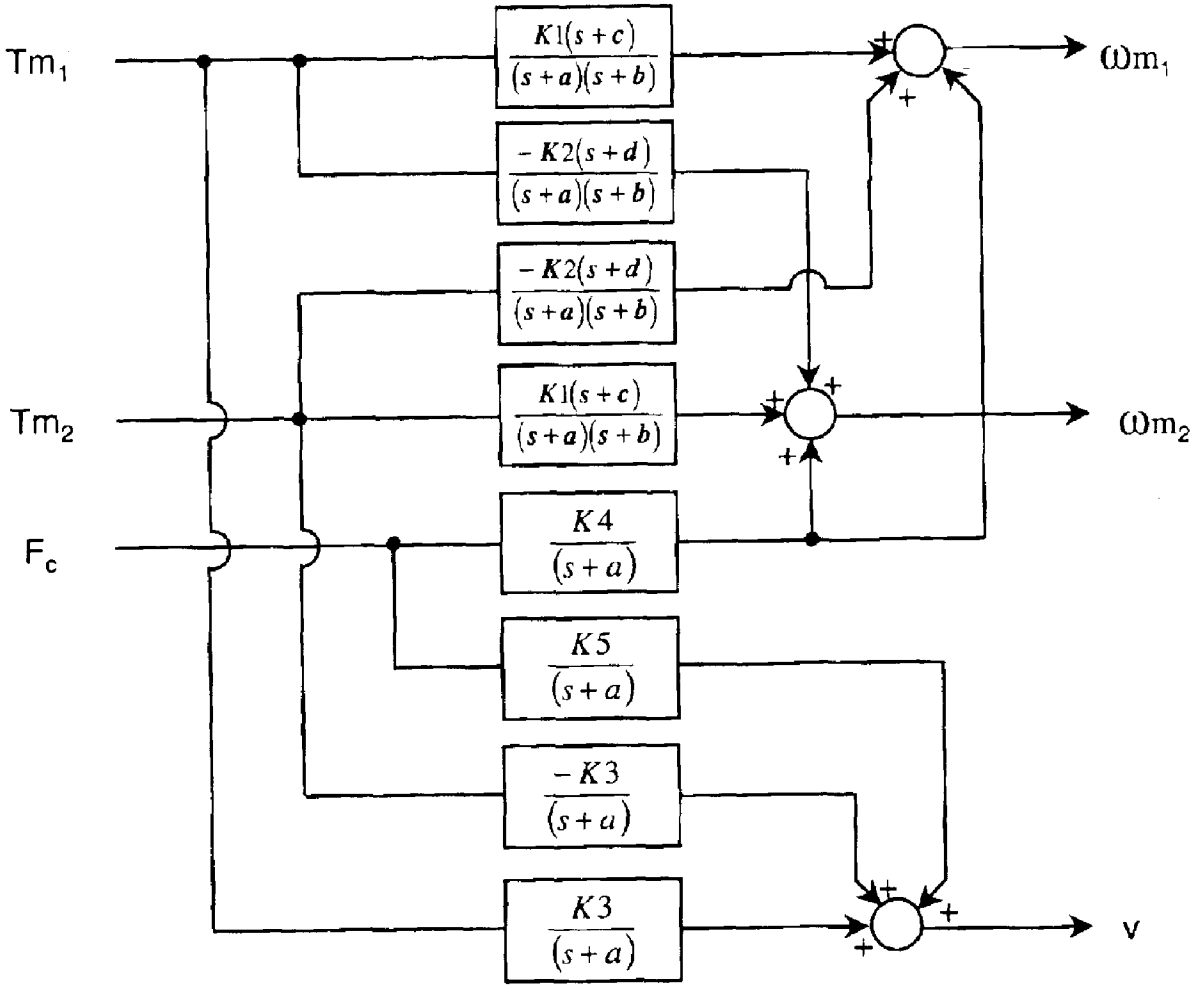
FIG. 2 is a block diagram showing the transfer function for the three inputs ($T_{m1}$, $T_{m2}$ and $F_c$) and three outputs ($\omega m_1$, $\omega m_2$ and v) for the accumulator of FIG. 1.

Both the mathematical equations (3) and (4) and the block diagram of FIG. 2 describe a control system having 3 inputs ($T_{m1}$, $T_{m2}$ and $F_c$) and 3 outputs ($\omega m_1$, and $\omega m_2$ and v) that includes coupling between each input and each output. Therefore, any combination of two inputs is sufficient to drive all three outputs to their desired states within the physical limits of the system. This is also apparent from the diagram of FIG. 1. Thus, the accumulator 100 system can be controlled by driving the web input roller 104$_{d1}$ and the carriage 108, or the carriage 108 and the web output roller 104$_{d2}$, or the input and output web rollers 104$_{d1}$, 104$_{d2}$.

While the invention of the present application is generally applicable to accumulator systems wherein any two of the three inputs are controlled, for this description, only the accumulator 100 system that is controlled by controlling the servomotors 110, 114 that drive the input and output web rollers 104$_{d1}$, 104$_{d2}$, respectively, with no force being applied to the carriage 108 i.e., $F_c$=0, will be described. Compensation arrangements in accordance with the present invention for disturbances generated when the carriage 108 is driven together with one of the input and output web rollers 108$_{d1}$, 104$_{d2}$ will be apparent to those skilled in the art and, since their description would be redundant to the present description, will not be described herein.

For compensation of torque disturbances, a subset of G, defined by removing the force input Fc, i.e., the 3$^{rd}$ row and 3$^{rd}$ column of G, describing the relationship between motor torques and motor velocities is used with the corresponding transfer function, $G_s$, being:

$$G_s = \begin{bmatrix} \frac{K1(s+c)}{(s+a)(s+b)} & \frac{-K2(s+d)}{(s+a)(s+b)} \\ \frac{-K2(s+d)}{(s+a)(s+b)} & \frac{K1(s+c)}{(s+a)(s+b)} \end{bmatrix}$$

Figure 3:
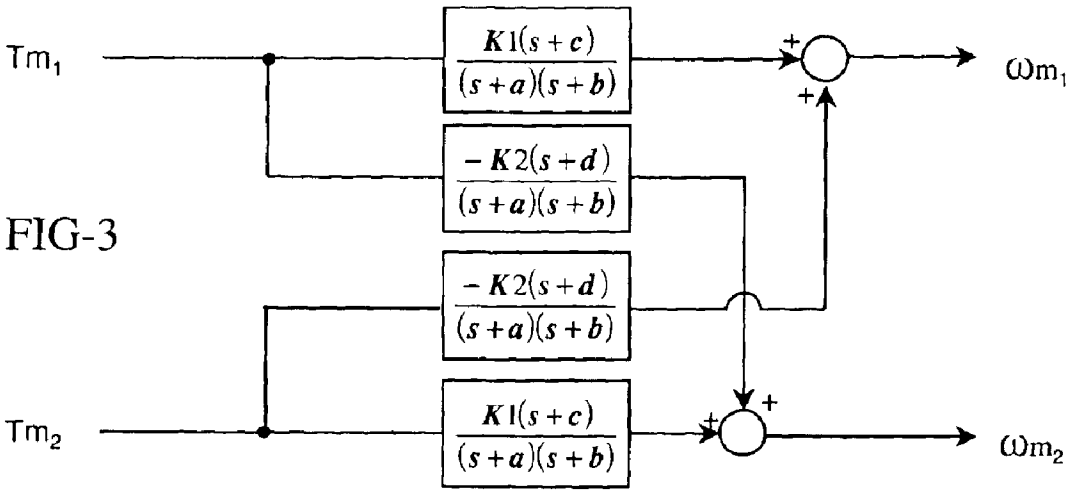
FIG. 3 is a block diagram showing the transfer function for the relationship between motor torques ($T_{m1}$, $T_{m2}$) and motor velocities ($\omega m_1$, $\omega m_2$) for the accumulator of FIG. 1, a subset of the transfer function of FIG. 2.

A corresponding block diagram is shown in FIG. 3.

In order to move the carriage 108 up or down, to accumulate or discharge web, respectively, a net opposing torque must exist between the torques $T_{m1}$ and $T_{m2}$. At the same time, the velocity of the web 102 is to be maintained constant at the web output roller 104$_{d2}$ of the accumulator 100 ($\omega_{2n+1}=\omega m_2/ng_2$) regardless of whether or not the carriage is moving. This is accomplished by the invention of the present application in one of two ways: 1) ensuring that the gear ratio $ng_2$ is large enough to make the reflected torque from $T_{m1}$ to $T_{m2}$ negligible with respect to velocity control of $\omega_{m2}$, i.e., $ng_2>1$ and, for example 2 or around 2) compensating the velocity control system so that the opposing torque required to move the carriage does not disturb the motor velocity $\omega m_2$. Similarly, a sufficiently large gear ratio $ng_1$ is required to suppress torque disturbances from $T_{m2}$ to $T_{m1}$, or the velocity controller for $\omega m_1$ must be compensate for changes in torque applied to the web output roller 104$_{d2}$. When gear ratios alone are insufficient to meet the performance demands of the accumulator, the velocity controllers must be compensated as described above. Such compensation is known as "decoupling."

Figure 4:
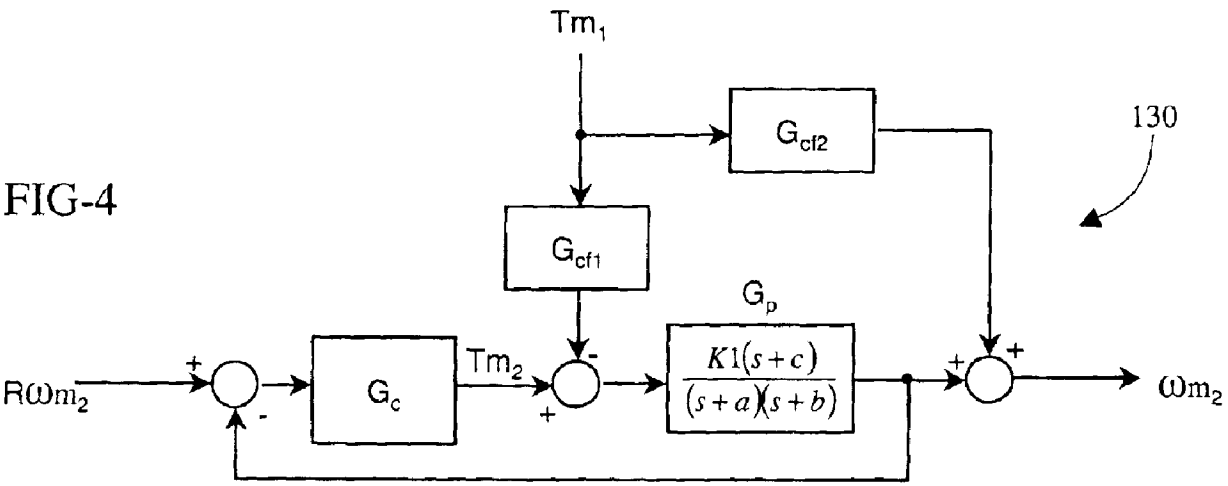
FIG. 4 is a block diagram of a two degree of freedom controller incorporated into a velocity loop for the output web roller to implement the torque feed-forward control of the present invention.

Decoupling can be accomplished by using torque feed-forward control from the input web roller 104$_{d1}$ to the output web roller 104$_{d2}$ and from the output web roller 104$_{d2}$ to the input web roller 104$_{d1}$, or by using decoupling by state feedback. A two degree of freedom controller 130, shown in FIG. 4, is incorporated into the velocity loop for the output web roller 104$_{d2}$ to implement torque feed-forward control. $R\omega m_2$ is the velocity reference or set velocity for the second servomotor 114 that drives the web output roller $\mathbf{104}_{d2}$, $G_c$ is the velocity controller, and $G_p$ is the torque to velocity transfer function from $T_{m2}$ to $\omega m_2$. $G_{c/1}$ and $G_{c/2}$ represent a two degrees of freedom controller with their values selected so that the impact of $T_{m1}$ on $\omega m_2$ is cancelled.

From FIG. 3, it is noted that $G_{c/2}$ is the transfer function from $T_{m1}$ to $\omega m_2$. A solution of the system of FIG. 3 for a value of $G_{c/1}$ that cancels the affect of $T_{m1}$ on $\omega m_2$, the desired value of the torque feed-forwarded controller ($G_{c/1}$), is:

$$G_{cf1} = \frac{G_{cf2}}{G_p} = \frac{\dfrac{-K2(s+d)}{(s+a)(s+b)}}{\dfrac{K1(s+c)}{(s+a)(s+b)}} = \frac{\dfrac{-K2}{K1}(s+d)}{(s+c)}$$

Figure 5:
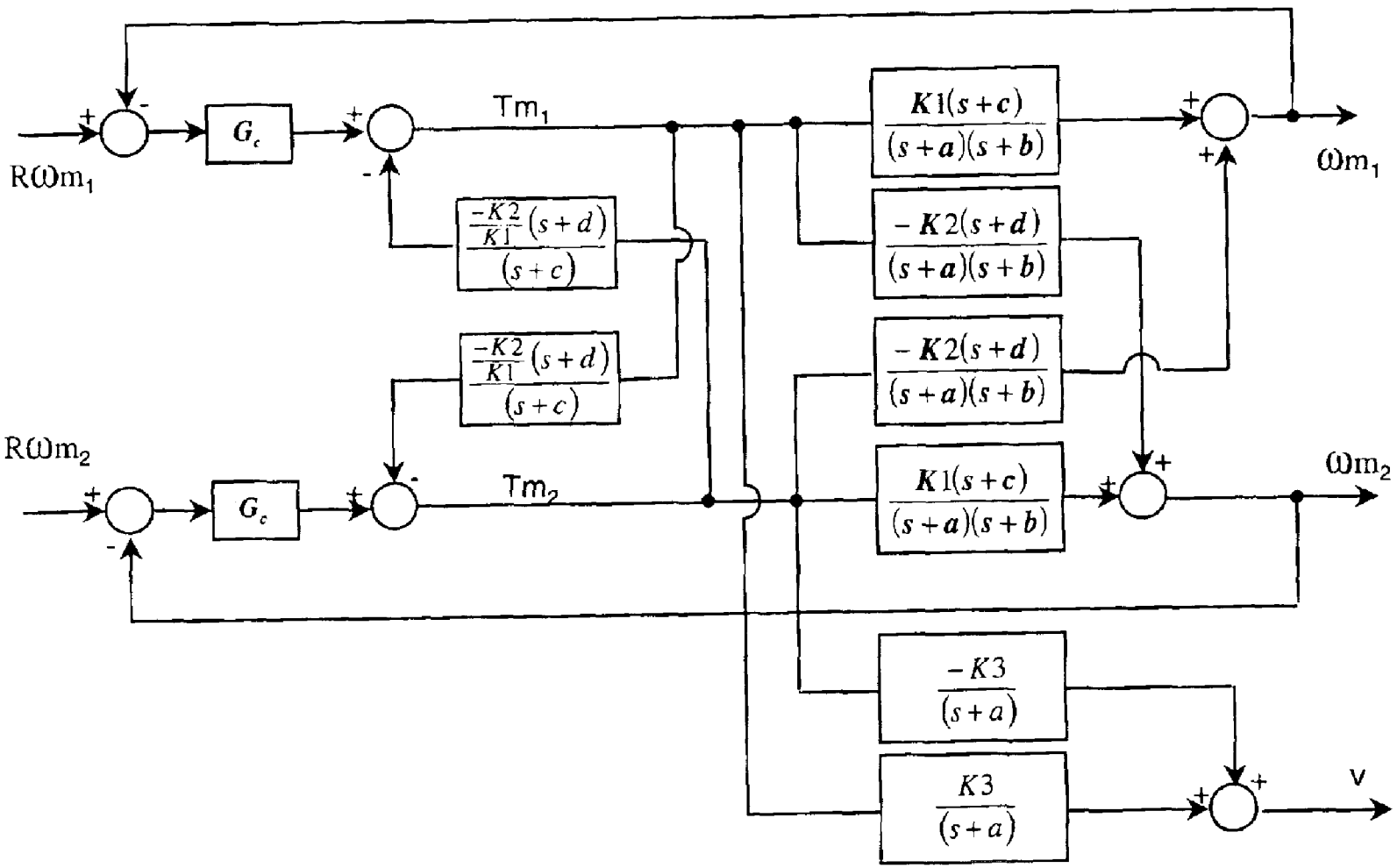
FIG. 5 is a block diagram of a two degrees of freedom controller incorporated into velocity loops for the input and output web rollers to implement torque feed-forward control.

Corresponding compensation to eliminate the impact of $T_{m2}$ on $\omega m_1$ is shown by the block diagram of compensated velocity loops of FIG. 5.

In most applications, suppressing the torque disturbance with sufficiently large gear ratios, or decoupling by torque feed-forward compensation will be adequate; however, for very high performance systems, additional improvements can be made. In particular, knowledge of the current outputs, or states, of the system can be used, in addition to torque feed-forward, to further refine the torque commands, $T_{m1}$ and $T_{m2}$. One method that encompasses both the torque feed-forward and the feedback of the current outputs, or states, is referred to as decoupling by state feedback. This general control technique is well known in the art. Those desiring additional information on this topic are referred to *Linear System Theory and Design*, by Chi-Tsong Chen, ISBN 0-03-060289-0, which is incorporated herein by reference.

Define the constant matrix E:

$$\begin{aligned} E &\equiv \lim_{s \to \infty} s^{d_i+1} G_s \\ &= \lim_{s \to \infty} \begin{bmatrix} \dfrac{K1s^2 + K1sc}{s^2 + (a+b)s + ab} & \dfrac{-K2s^2 - K2sd}{s^2 + (a+b)s + ab} \\ \dfrac{-K2s^2 - K2sd}{s^2 + (a+b)s + ab} & \dfrac{K1s^2 + K1sc}{s^2 + (a+b)s + ab} \end{bmatrix} \\ &= \begin{bmatrix} K1 & -K2 \\ -K2 & K1 \end{bmatrix} \end{aligned}$$

Where $d_1$ is the difference in degree in s of the denominator ad the numerator in each entry of the ith row of G-1.

The system with transfer function matrix $G_s$ can be decoupled with state variable feedback of the form $u=K_{SF1}x+Hr$ if $K_{SK1}$ and H are chosen as follows:

$$K_{SF1} = -E^{-1}F$$

$$H = E^{-1}$$

Where:

$$F \equiv \begin{bmatrix} C_1 A^{d_1+1} \\ C_2 A^{d_2+1} \\ \vdots \\ C_p A^{d_p+1} \end{bmatrix},$$

and $C_1, C_2, \ldots C_p$ are the rows of the output matrix C. Computing the new coefficient matrices of the state feedback system, we get:

$$A_{SF} = A + BK_{SF1}$$

$$B_{SF} = BH$$

And the transfer function matrix of the decoupled system is:

$$G_{SF} = C[sI - A_{SF}]^{-1} B_{SF} = \begin{bmatrix} \dfrac{1}{s} & 0 \\ 0 & \dfrac{1}{s} \end{bmatrix}$$

Figure 6:
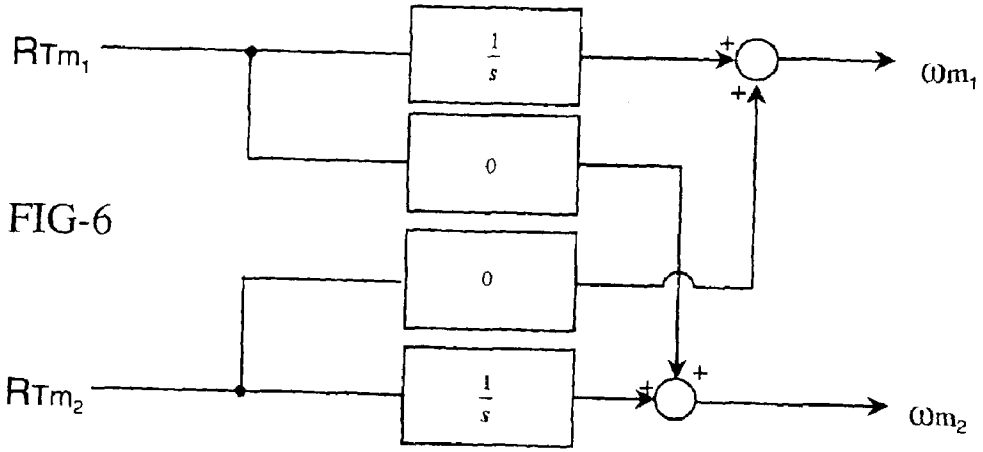
FIG. 6 is a block diagram of the system shown in FIG. 3 where decoupling has been accomplished by state feedback.

This system is indeed decoupled and the equivalent block diagram is shown in FIG. 6. Decoupling by state feedback moves all of the system poles to the origin, which leads to unsatisfactory dynamics; therefore, state feedback is applied a second time to move the poles of the system back to their original neighborhood, the net effect is to modify the system matrix $A_{SF}$, so that the final, compensated system matrix, $A_{SF2}$ is:

$$A_{SF2} = A + BK_{SF1} + BHK_{SF2}$$

The final transfer function matrix is:

$$G_{SF2} = C[sI - A_{SF2}]^{-1} B_{SF} = \begin{bmatrix} \dfrac{1}{s+a} & 0 \\ 0 & \dfrac{1}{s+a} \end{bmatrix}$$

Figure 7:
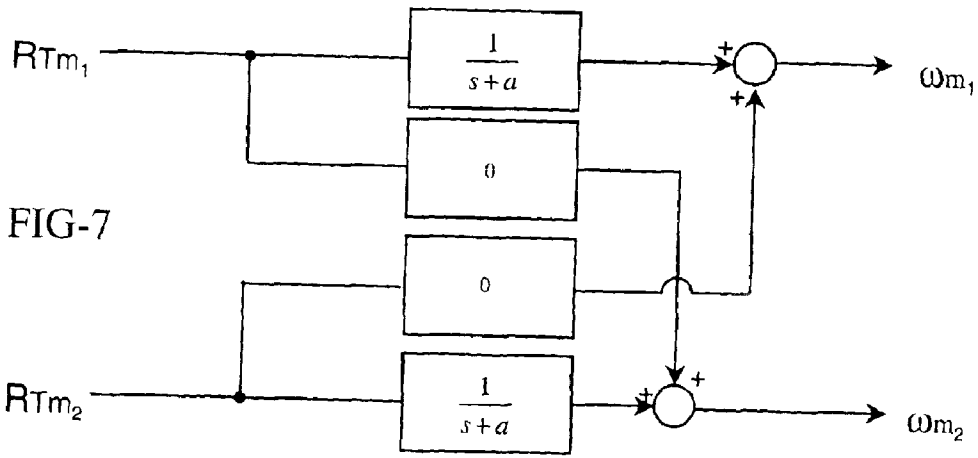
FIG. 7 is a block diagram of the system shown in FIG. 6 where state feedback has been applied a second time to improve the dynamic performance of the decoupled system.

And the equivalent block diagram is shown in FIG. 7. To summarize the decoupling and compensation, an equivalent gain $K_e$ is defined as:

$$K_e = BK_{SK1} + BHK_{SF2}$$

Figure 8:
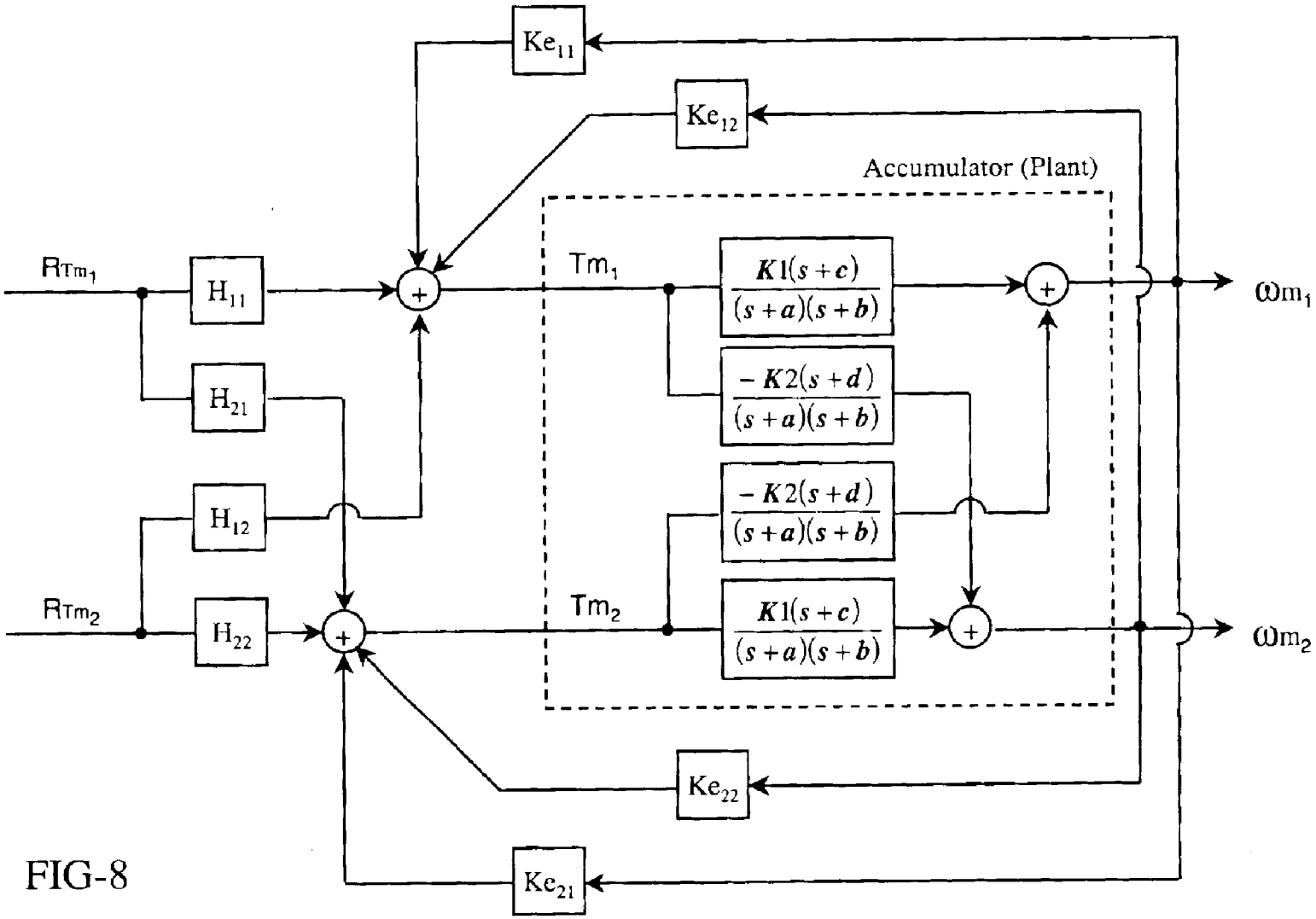
FIG. 8 is a block diagram showing that decoupling by state feedback is essentially a combination of torque feed-forward and state velocity feedback.

Since H and Ke are 2×2 coefficient matrices, the system can be represented in block diagram form as shown in FIG. 8.

Comparing FIG. 8 to the torque feed-forward system in FIG. 5, it is noted that both control arrangements use torque feed-forward (the torque command, $T_{m1}$, is scaled by the transfer function $G_{CN}$), in addition, the system decoupled by state feedback also uses velocity feedback from each input to determine the best torque commands, $T_{m1}$ and $T_{m2}$. However, there is a key difference in the implementation of torque feed-forward. The torque feed-forward controller, $G_{CN}$, is a filter, while the elements of the state feedback compensator are scalar multipliers. In other words, provided the states are made available for control, by sensors, observers or a combination of sensors and observers, the state feedback system can be implemented by performing simple arithmetic operations on the torque command in the servo controller.

In a physical implementation of the control systems of the present application, $T_{m1}$ and $T_{m2}$ are torque commands rather than actual mechanical torque. The conversion to mechanical torque occurs inside the torque loop of the servo system. Further, since torque loops of modern servo systems are very responsive, it is common in applications like this one, to represent the conversions as simple proportionally constants rather than transfer functions. Therefore, additional scaling is necessary depending on the capabilities of the servo system chosen for a given application.

Having thus described the invention of the present application in detail and by reference to illustrated embodiments thereof, it will be apparent that modifications and variations are possible without departing from the scope of the invention defined in the appended claims.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention;

What is claimed is:

1. A web accumulator comprising:

first and second sets of rotatably mounted web rollers, each of said web rollers being partially wrapped by a web when looped alternately from a web roller of said first set to a web roller of said second set in consecutive order, said second set of web rollers being mounted for movement relative to said first set of web rollers;

a flexible drive element separate from the web for rotating each web roller at approximately the speed of a web portion in contact with it when discharging web from said accumulator and when accumulating web in said accumulator;

driving apparatus for driving two of an input web roller, an output web roller and movement of said second set of web rollers relative to said first set of web rollers; and a controller for controlling said driving apparatus to decouple said input web roller and said output web roller, wherein said driving apparatus comprises a first servomotor driving said input web roller and a second servomotor driving said output web roller, wherein said controller comprises a torque feed-forward control system, wherein said torque feed-forward control system provides a proportional, additive, torque command to said second servomotor corresponding to each change in a torque command of said first servomotor, whereby said torque command to said second servomotor will effectively cancel a torque disturbance experienced by said second servomotor through mechanical coupling to said first servomotor.

2. A web accumulator as claimed in claim 1 wherein said controller comprises:

a first gearbox coupling said first servomotor to said input web roller, said first gearbox having a gear ratio>1; and a second gearbox coupling said second servomotor to said output web roller, said second gearbox having a gear ratio>1.

3. A web accumulator s claimed in claim 2 wherein said first gearbox has a gear ratio of around 2 and said second gearbox has a gear ratio of around 2.

4. A web accumulator comprising:

first and second sets of rotatably mounted web rollers, each of said web rollers being partially wrapped by a web when looped alternately from a web roller of said first set to a web roller of said second set in consecutive order, said second set of web rollers being mounted for movement relative to said first set of web rollers;

a flexible drive element separate from the web for rotating each web roller at approximately the speed of a web portion in contact with it when discharging web from said accumulator and when accumulating web in said accumulator;

driving apparatus for driving two of an input web roller, an output web roller and movement of said second set of web rollers relative to said first set of web rollers; and a controller for controlling said driving apparatus to decouple said input web roller and said output web roller, wherein said driving apparatus comprises a first servomotor driving said input web roller and a second servomotor driving said output web roller;

wherein said controller comprises a torque feed-forward control system, wherein said torque feed-forward control system provides a proportional, additive, velocity-command to said second servomotor corresponding to each change in a torque command of said first servomotor, whereby said torque command to said second servomotor will effectively cancel a torque disturbance experienced by said second servomotor through mechanical coupling to said first servomotor.

5. A web accumulator comprising:

first and second sets of rotatably mounted web rollers, each of said web rollers being partially wrapped by a web when looped alternately from a web roller of said first set to a web roller of said second set in consecutive order, said second set of web rollers being mounted for movement relative to said first set of web rollers;

a flexible drive element separate from the web for rotating each web roller at approximately the speed of a web portion in contact with it when discharging web from said accumulator and when accumulating web in said accumulator;

driving apparatus for driving two of an input web roller, an output web roller and movement of said second set of web rollers relative to said first set of web rollers; and a controller for controlling said driving apparatus to decouple said input web roller and said output web roller, wherein said controller comprises a torque feed-forward system and a velocity feedback control system, wherein said driving apparatus comprises a first servomotor driving said input web roller and a second servomotor driving said output web roller, wherein said torque feed-forward system and said velocity feedback control system provides a proportional, additive, torque command to said first and second servomotors, said torque command is calculated based upon arithmetic combinations of said first and second servomotors' present torque commands and present velocities, whereby said torque command will effectively cancel a torque disturbance experienced by one of said servomotors through mechanical coupling to the other said servomotor.

6. A web accumulator comprising:

first and second sets of rotatably mounted web rollers, each of said web rollers being partially wrapped by a web when looped alternately from a web roller of said first set to a web roller of said second set in consecutive order, said second set of web rollers being mounted for movement relative to said first set of web rollers;

a flexible drive element separate from the web for rotating each web roller at approximately the speed of a web portion in contact with it when discharging web from said accumulator and when accumulating web in said accumulator;

driving apparatus for driving two of an input web roller, an output web roller and movement of said second set of web rollers relative to said first set of web rollers; and a controller for controlling said driving apparatus to decouple said input web roller and said output web roller, wherein said controller comprises a torque feed-forward system and a velocity feedback control system, wherein said driving apparatus comprises a first servomotor driving said input web roller and a second servomotor driving said output web roller, wherein said torque feed-forward system and said velocity feedback control system provides a proportional, additive, torque command to said first and second servomotors, said torque command is calculated based upon arithmetic combinations of said first and second servomotors' present torque commands and observer-based estimates of said servomotors' velocities, whereby said torque command will effectively cancel a torque disturbance experienced by one of said servomotors through mechanical coupling to the other said servomotor.

7. A web accumulator comprising:

first and second sets of rotatably mounted web rollers, each of said web rollers being partially wrapped by a web when looped alternately from a web roller of said first set to a web roller of said second set in consecutive order, said second set of web rollers being mounted for movement relative to said first set of web rollers;

a flexible drive element separate from the web for rotating each web roller at approximately the speed of a web portion in contact with it when discharging web from said accumulator and when accumulating web in said accumulator;

driving apparatus for driving two of an input web roller, an output web roller and movement of said second set of web rollers relative to said first set of web rollers; and a controller for controlling said driving apparatus to decouple said input web roller and said output web roller, wherein said controller comprises a torque feed-forward system and a velocity feedback control system, wherein said driving apparatus comprises a first servomotor driving said input web roller and a second servomotor driving said output web roller, wherein said torque feed-forward system and said velocity feedback control system provides a proportional, additive, torque command to said first and second servomotors, said torque command is calculated based upon arithmetic combinations of observer-based estimates of said first and second servomotors' present torque commands and present velocities, whereby said torque command will effectively cancel a torque disturbance experienced by one of said servomotors through mechanical coupling to the other said servomotor.

8. A web accumulator comprising:

first and second sets of rotatably mounted web rollers, each of said web rollers being partially wrapped by a web when looped alternately from a web roller of said first set to a web roller of said second set in consecutive order, said second set of web rollers being mounted for movement relative to said first set of web rollers;

a flexible drive element separate from the web for rotating each web roller at approximately the speed of a web portion in contact with it when discharging web from said accumulator and when accumulating web in said accumulator;

driving apparatus for driving two of an input web roller, an output web roller and movement of said second set of web rollers relative to said first set of web rollers; and a controller for controlling said driving apparatus to decouple said input web roller and said output web roller, wherein said controller comprises a torque feed-forward system and a velocity feedback control system, wherein said driving apparatus comprises a first servomotor driving said input web roller and a second servomotor driving said output web roller, wherein said torque feed-forward system and said velocity feedback control system provides a proportional, additive, torque command to said first and second servomotors, said torque command is calculated based upon arithmetic combinations of observer-based estimates of said first and second servomotors' present torque commands and observer-based estimates of said servomotors' velocities, whereby said torque command will effectively cancel a torque disturbance experienced by one of said servomotors through mechanical coupling to the other said servomotor.

9. A web accumulator comprising:

first and second sets of rotatably mounted web rollers, each of said web rollers being partially wrapped by a web when looped alternately from a web roller of said first set to a web roller of said second set in consecutive order, said second set of web rollers being mounted for movement relative to said first set of web rollers;

a flexible drive element separate from the web for rotating each web roller at approximately the speed of a web portion in contact with it when discharging web from said accumulator and when accumulating web in said accumulator;

driving apparatus for driving two of an input web roller, an output web roller and movement of said second set of web rollers relative to said first set of web rollers; and a controller for controlling said driving apparatus to decouple said input web roller and said output web roller, wherein the driving apparatus a first servomotor and a second servomotor, wherein said servomotors drive two of three of said input web roller, said output web roller and said second set of web rollers, respectively, wherein said controller comprises a torque feed-forward control system, wherein said torque feed-forward control system provides a proportional, additive, torque command to said second servomotor corresponding to each change in a torque command of said first servomotor, whereby said torque command to said second servomotor will effectively cancel a torque disturbance experienced by said second servomotor through mechanical coupling to said first servomotor.

10. A web accumulator comprising:

first and second sets of rotatably mounted web rollers, each of said web rollers being partially wrapped by a web when looped alternately from a web roller of said first set to a web roller of said second set in consecutive order, said second set of web rollers being mounted for movement relative to said first set of web rollers;

a flexible drive element separate from the web for rotating each web roller at approximately the speed of a web portion in contact with it when discharging web from said accumulator and when accumulating web in said accumulator;

driving apparatus for two of an input web roller, an output web roller and movement of said second set of web rollers relative to said first set of web rollers; and a controller for controlling said driving apparatus to decouple said input web roller and said output web roller, wherein the driving apparatus a first servomotor and a second servomotor wherein said servomotors drive two of three of said input web roller, said output web roller and said second set of web rollers, respectively, wherein said controller comprises a torque feed-forward control system, wherein said torque feed-forward control system provides a proportional, additive, velocity-command to said second servomotor corresponding to each change in a torque command of said first servomotor, whereby said torque command to said second servomotor will effectively cancel a torque disturbance experienced by said second servomotor through mechanical coupling to said first servomotor.

11. A web accumulator comprising:

first and second sets of rotatably mounted web rollers, each of said web rollers being partially wrapped by a web when looped alternately from a web roller of said first set to a web roller of said second set in consecutive order, said second set of web rollers being mounted for movement relative to said first set of web rollers;

a flexible drive element separate from the web for rotating each web roller at approximately the speed of a web portion in contact with it when discharging web from said accumulator and when accumulating web in said accumulator;

driving apparatus for driving two of an input web roller, an output web roller and movement of said second set of web rollers relative to said first set of web rollers; and a controller for controlling said driving apparatus to decouple said input web roller and said output web roller, wherein the driving apparatus a first servomotor and a second servomotor, wherein said servomotors drive two of three of said input web roller, said output web roller and said second set of web rollers, respectively, wherein said controller comprises both a torque feed-forward system and a velocity feedback control system, wherein said driving apparatus comprises a first servomotor driving said input web roller and a second servomotor driving said output web roller, wherein said torque feed-forward system and said velocity feedback control system provides a proportional, additive, torque command to said first and second servomotors, said torque command is calculated based upon arithmetic combinations of said first and second servomotors' present torque commands and present velocities, whereby said torque command will effectively cancel a torque disturbance experienced by one of said servomotors through mechanical coupling to the other said servomotor.

12. A web accumulator comprising:

first and second sets of rotatably mounted web rollers, each of said web rollers being partially wrapped by a web when looped alternately from a web roller of said first set to a web roller of said second set in consecutive order, said second set of web rollers being mounted for movement relative to said first set of web rollers;

a flexible drive element separate from the web for rotating each web roller at approximately the speed of a web portion in contact with it when discharging web from said accumulator and when accumulating web in said accumulator;

driving apparatus for driving tow of an input web roller, an output web roller and movement of said second set of web rollers relative to said first set of web rollers; and a controller for controlling said driving apparatus to decouple said input web roller and said output web roller, wherein the driving apparatus a first servomotor and a second servomotor wherein said servomotors drive two of three of said input web roller, said output web roller and said second set of web rollers, respectively, wherein said controller comprises both a torque feed-forward system and a velocity feedback control system, wherein said torque feed-forward system and said velocity feedback control system provides a proportional, additive, torque command to said first and second servomotors, said torque command is calculated based upon arithmetic combinations of said first and second servomotors' present torque commands and observer-based estimates of said servomotors' velocities, whereby said torque command will effectively cancel a torque disturbance experienced by one of said servomotors through mechanical coupling to the other said servomotor.

* * * * *

UNITED STATES PATENT AND TRADEMARK OFFICE

CERTIFICATE OF CORRECTION

PATENT NO. : 6,966,474 B2 
DATED : November 22, 2005
INVENTOR(S) : Eric Christopher Berg et al.

It is certified that error appears in the above-identified patent and that said Letters Patent is hereby corrected as shown below:

Title page,
Item [57], ABSTRACT,
Line 1, delete "decoupled" and insert -- decouples --.
Line 3, delete "toque" and insert -- torque --.

Column 1,
Line 39, delete "strain values," and insert -- low strain values, --.
Line 40, delete "and" and insert -- an --.

Column 2,
Line 34, delete "decoupled" and insert -- decouple --.

Column 4,
Lines 16-37, delete equation (3) in its entirety and insert $$
\begin{aligned}
\text{--}\ & \left(n_{g_1}^2 J_{m_1} + J_d + J_p\left(1+\frac{1}{4n^2}\sum_{i=2}^{2n}(2n+1-i)^2\right) + \frac{J}{4n^2}\sum_{i=2}^{2n}(2n+1-i)^2 + \frac{Mr^2}{4n^2}\right)\frac{1}{n_{g_1}^2}\alpha_{m_1} \\
& + \left(\frac{J_p}{4n^2}\sum_{i=2}^{2n}((2n+1-i)(i-1)) + \frac{J}{4n^2}\sum_{i=2}^{2n}((2n+1-i)(i-1)) - \frac{Mr^2}{4n^2}\right)\frac{1}{n_{g_2}^2}\alpha_{m_2} \\
& + \left(n_{g_1}^2 B_{m_1} + B_d + B_p\left(1+\frac{1}{4n^2}\sum_{i=2}^{2n}(2n+1-i)^2\right) + \frac{B_r}{4n^2}\sum_{i=2}^{2n}(2n+1-i)^2 + \frac{B_y r^2}{4n^2}\right)\frac{1}{n_{g_1}^2}\omega_{m_1} \\
& + \left(\frac{B_p}{4n^2}\sum_{i=2}^{2n}((2n+1-i)(i-1)) + \frac{B_r}{4n^2}\sum_{i=2}^{2n}((2n+1-i)(i-1)) - \frac{B_y r^2}{4n^2}\right)\frac{1}{n_{g_2}^2}\omega_{m_2} \\
& = T_{m_1} - \frac{1}{n_{g_1}}\frac{r}{2n}\mathrm{F_c} \qquad (3)\ \text{--.}
\end{aligned}
$$

UNITED STATES PATENT AND TRADEMARK OFFICE

CERTIFICATE OF CORRECTION

PATENT NO. : 6,966,474 B2
DATED : November 22, 2005
INVENTOR(S) : Eric Christopher Berg et al.

It is certified that error appears in the above-identified patent and that said Letters Patent is hereby corrected as shown below:

Column 4 (cont'd),
Lines 40-58, delete equation (4) in its entirety and insert

-- $$\left(\frac{J_p}{4n^2}\sum_{i=2}^{2n}((2n+1-i)(i-1))+\frac{J}{4n^2}\sum_{i=2}^{2n}((2n+1-i)(i-1))-\frac{Mr^2}{4n^2}\right)\frac{1}{n_{g_1}^2}\alpha_{m_1}$$
$$+\left(n_{g_2}^2 J_{m_2}+J_d+J_p\left(1+\frac{1}{4n^2}\sum_{i=2}^{2n}(2n+1-i)^2\right)+\frac{J}{4n^2}\sum_{i=2}^{2n}(2n+1-i)^2+\frac{Mr^2}{4n^2}\right)\frac{1}{n_{g_2}^2}\alpha_{m_2}$$
$$+\left(\frac{B_p}{4n^2}\sum_{i=2}^{2n}((2n+1-i)(i-1))+\frac{B_r}{4n^2}\sum_{i=2}^{2n}((2n+1-i)(i-1))-\frac{B_y r^2}{4n^2}\right)\frac{1}{n_{g_1}^2}\omega_{m_1}$$
$$+\left(n_{g_2}^2 B_{m_2}+B_d+B_p\left(1+\frac{1}{4n^2}\sum_{i=2}^{2n}(2n+1-i)^2\right)+\frac{B_r}{4n^2}\sum_{i=2}^{2n}(2n+1-i)^2+\frac{B_y r^2}{4n^2}\right)\frac{1}{n_{g_2}^2}\omega_{m_2}$$
$$=Tm_2+\frac{1}{n_{g_2}}\frac{r}{2n}\mathrm{F_c} \qquad (4)$$ --.

Column 5,
Line 1, delete "$B_t$" and insert -- $B_r$ --.
Line 6, delete "$B_{d1}$" and insert -- $B_d$ --.
Line 12, delete "166" and insert -- 116 --.
Line 24, delete "y direction" and insert -- y direction. --.

Column 6,
Line 20, delete "carriage 108" and insert -- carriage 108, --.
Line 24, delete "rollers $108_{d1}$, $104_{d2}$" and insert -- rollers $104_{d1}$, $104_{d2}$ --.
Line 54, delete "compensate" and insert -- compensated --.
Line 64, delete "degree" and insert -- degrees --.

Column 7,
Line 3, delete "$G_{c/1}$ and $G_{c/2}$" and insert -- $G_{cf1}$ and $G_{cf2}$ --.
Line 6, delete "$G_{c/2}$" and insert -- $G_{cf2}$ --.
Line 8, delete "$G_{c/1}$" and insert -- $G_{cf1}$ --.
Line 9, delete "feed-forwarded controller ($G_{c/1}$)," and insert -- feed-forwarded controller ($G_{cf1}$), --.
Line 49, delete "$d_1$" and insert -- $d_i$ --.
Line 50, delete "ad" and insert -- and --.
Line 53, delete "if $K_{sk1}$" and insert -- if $K_{sf1}$ --.

UNITED STATES PATENT AND TRADEMARK OFFICE

CERTIFICATE OF CORRECTION

PATENT NO. : 6,966,474 B2
DATED : November 22, 2005
INVENTOR(S) : Eric Christopher Berg et al.

It is certified that error appears in the above-identified patent and that said Letters Patent is hereby corrected as shown below:

Column 8,
Line 1, delete "...$C_p$" and insert -- ..,$C_p$ --.
Line 37, delete "$K_e$=$BK_{sk1}$ +$BHK_{sf2}$" and insert -- $K_e$=$BK_{sf1}$+$BHK_{sf2}$ --.
Line 44, delete "$G_{cn}$)," and insert -- $G_{cf1}$), --.
Line 49, delete "$G_{cn}$," and insert -- $G_{cf1}$, --.
Line 62, delete "proportionally" and insert -- proportionality --.

Column 9,
Line 15, delete "invention;" and insert -- invention. --.
Line 56, delete "A web accumulator s" and insert -- A web accumulator as --.

Column 13,
Line 10, delete "driving apparatus for two" and insert -- driving apparatus for driving two --.

Column 14,
Line 28, delete "tow" and insert -- two --.

Signed and Sealed this

Fourth Day of April, 2006

JON W. DUDAS
*Director of the United States Patent and Trademark Office*